United States Patent [19]

Hayes

[11] Patent Number: 4,881,445

[45] Date of Patent: Nov. 21, 1989

[54] SHAPED CHARGE

[75] Inventor: Scott L. Hayes, Mansfield, Tex.

[73] Assignee: Goex, Inc., Cleburne, Tex.

[21] Appl. No.: 251,200

[22] Filed: Sep. 29, 1988

[51] Int. Cl.[4] ..... E21B 7/00; E21B 43/117

[52] U.S. Cl. ..... 89/1.15; 102/306; 175/4.6

[58] Field of Search ..... 89/1.15; 102/306, 307, 102/701; 175/4.6

[56] References Cited

U.S. PATENT DOCUMENTS

| | | | |
|---|---|---|---|
| 3,327,630 | 6/1967 | Bell | 102/306 |
| 3,991,836 | 11/1976 | Bouguyon et al. | 175/4.6 |
| 4,784,061 | 11/1988 | Christopher | 102/306 |

*Primary Examiner*—David H. Brown

*Attorney, Agent, or Firm*—Arthur F. Zobal; Geoff Mantooth

[57] ABSTRACT

A shaped charge has provision for bleeding off internal pressure. The shaped charge has a case, a cap, and an O-ring. The case and the cap each have a first end. The case and the cap are assembled together by one of the first ends receiving the other first end. A groove is formed between the case and the cap; the groove receives the O-ring. The groove is provided with a gap on the external pressure side of the O-ring. The gap communicates with the exterior of the shaped charge. When internal pressure is greater than external pressure, the O-ring is deformd and extrudes into the gap, thereby exposing the gap to the internal pressure and allowing the internal pressure to vent out of the shaped charge. The gap is formed either by beveling an edge of the groove or by a borehole extending from a position that communicates with the exterior of the shaped charge to an opening in the groove.

29 Claims, 4 Drawing Sheets

SHAPED CHARGE

FIELD OF THE INVENTION

The present invention relates to shaped charge well perforating apparatuses, and in particular to the shaped charges making up well perforating apparatuses.

BACKGROUND OF THE INVENTION

Well perforating apparatuses typically utilize shaped charges for perforating well casing. The individual shaped charges are mounted onto a shaped charge carrier strip in linear fashion. Each shaped charge includes a case, which contains the explosive charge, and a cap, which encapsulates the explosive charge. A seal means is provided between the case and the cap for keeping the explosive charge dry when the shaped charge is lowered downhole. The seal means also prevents the bleed off of internal pressure.

When shaped charges are lowered downhole, they encounter high temperatures which cause the explosive charge to give off gas and increase the internal pressure. At sufficient depths, the increased internal pressure is unnoticed because it is counteracted by the high external hydrostatic pressure of the drilling fluid. Occasionally the shaped charges must be brought back to the surface in the unfired condition. As the shaped charges are brought back up towards the surface, the external hydrostatic pressure on the shaped charge is decreased. If the internal pressure is allowed to build up to some level greater than the external pressure, the case and the cap will separate, resulting in loose charges in the borehole; a situation which requires expensive operations to retrieve the charges.

In unusual circumstances, high temperatures may also be encountered when shaped charges are shipped by commercial carriers. The Department of Transportation (DOT) has expressed concern about the following possible scenario: a truck carrying shaped charges is involved in an accident and catches fire, which heats the shaped charges. This would result in an increase of internal pressure of the shaped charges. The high internal pressure could force the caps off in a projectile manner and increase the danger of the fire. To prevent such a scenario, the DOT has proposed stricter and more costly regulations in shipping shaped charges.

Thus, what is needed is a shaped charge that will bleed off internal pressure before the case and cap separate to prevent the separation of the case and cap in untimely situations.

SUMMARY OF THE INVENTION

It is an object of the present invention to provide a shaped charge that will bleed off internal pressure.

The shaped charge of the present invention includes a case, a cap, and elastomeric seal means. The case and the cap each have a first end and a cavity therein which opens to the first end. The respective case and cap first ends have respective first and second surfaces. The case and the cap are assembled together to form an enclosed cavity from the case and cap cavities by one of the first ends receiving the other first end such that the first and second surfaces face each other. An annular passageway is formed between the case and the cap; the passageway is formed by the clearance between the first and second surfaces. The passageway extends between the enclosed cavity and the exterior of the shaped charge. The seal means is confined within groove means formed in at least one of the first and second surfaces so as to provide a circumferential seal between the case and the cap. The groove means has a first portion which communicates with the exterior of the shaped charge. The seal means is deformable by differences between internal and external pressure.

Internal pressure inside of the enclosed cavity is bled off by providing gap means in the groove means on the external pressure side of the seal means. Normally the gap means communicates with the exterior of the shaped charge, but not with the enclosed cavity. If the internal pressure exceeds the external pressure so as to cause the seal means to deform in a given manner the gap means is exposed to the internal pressure by way of the passageway. Thus, internal pressure is vented.

In one aspect, the gap means is formed by a beveled surface. The groove means first portion includes the beveled surface which merges with the groove means and the one first or second surface in which the groove means is formed. The beveled surface is angled away from the respective surface of the opposing case or cap member. In this aspect, the gap means communicates with the exterior of the shaped charge through the clearance between the case and the cap. In another aspect, the gap means comprises an opening in the groove means. The opening is formed by a borehole which extends into the shaped charge. The borehole allows communication between the opening and the exterior of the shaped charge.

The case and the cap are retained together by retainer means. In one aspect, the retainer means is the seal means, which is received by grooves in both the first and second surfaces. The first and second surfaces extend longitudinally towards the ends of the respective case and cap. In another aspect, the retainer means is a snap ring received by corresponding grooves in the case and the cap.

In one aspect, the groove means is formed in both the case and the cap. In another aspect, the groove means is formed in the case.

DESCRIPTION OF PREFERRED EMBODIMENTS

Figure 1:
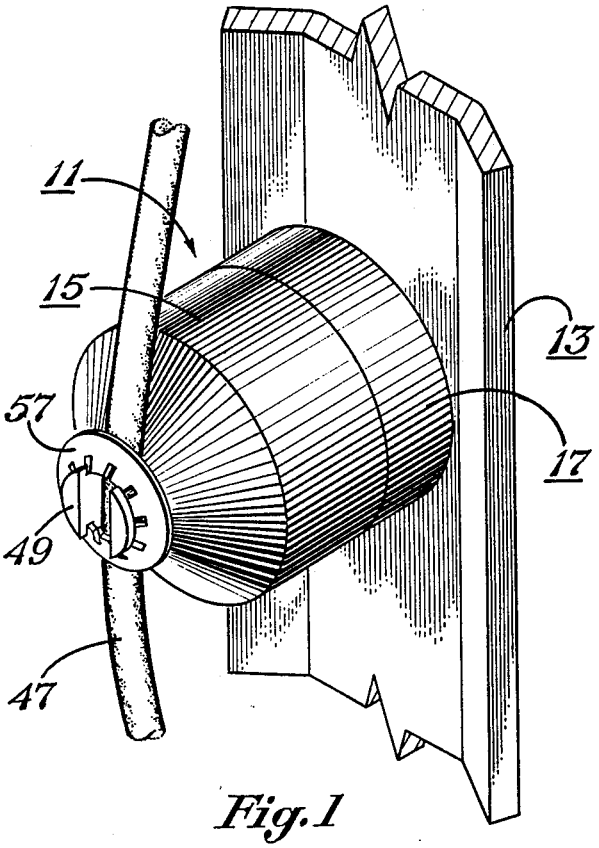
FIG. 1 is a schematic isometric view showing the shaped charge of the present invention, in accordance with a preferred embodiment.
Figure 2:
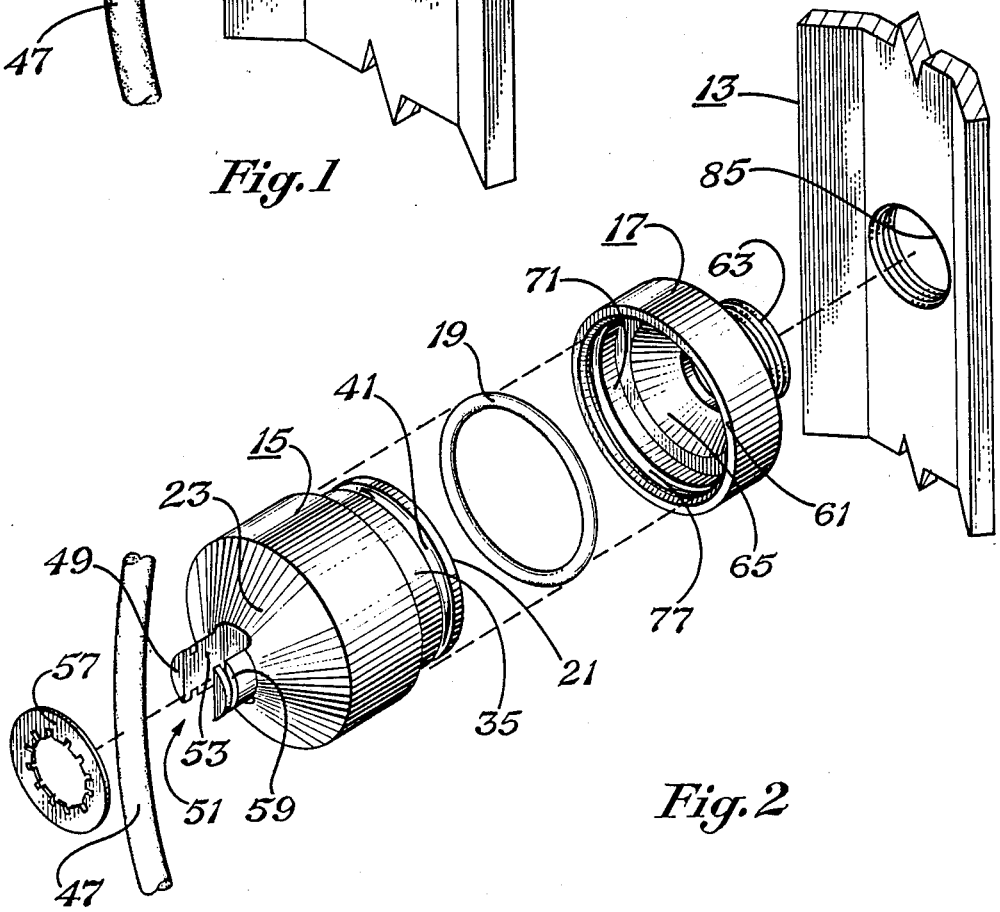
FIG. 2 is an exploded isometric view of the shaped charge of FIG. 1.

In FIGS. 1 and 2, there is shown a shaped charge 11 of the present invention, in accordance with a preferred embodiment, mounted onto a shaped charge carrier strip 13. In addition to the shaped charge 11 shown in FIGS. 1 and 2, there are usually a plurality of other similar shaped charges mounted onto the same shaped charge carrier 13. Such an assembly of shaped charges on a carrier is used to perforate well casing in oil or gas wells. The shaped charge of the present invention includes a case 15, a cap 17, and an elastomeric O-ring 19.

Figure 3:
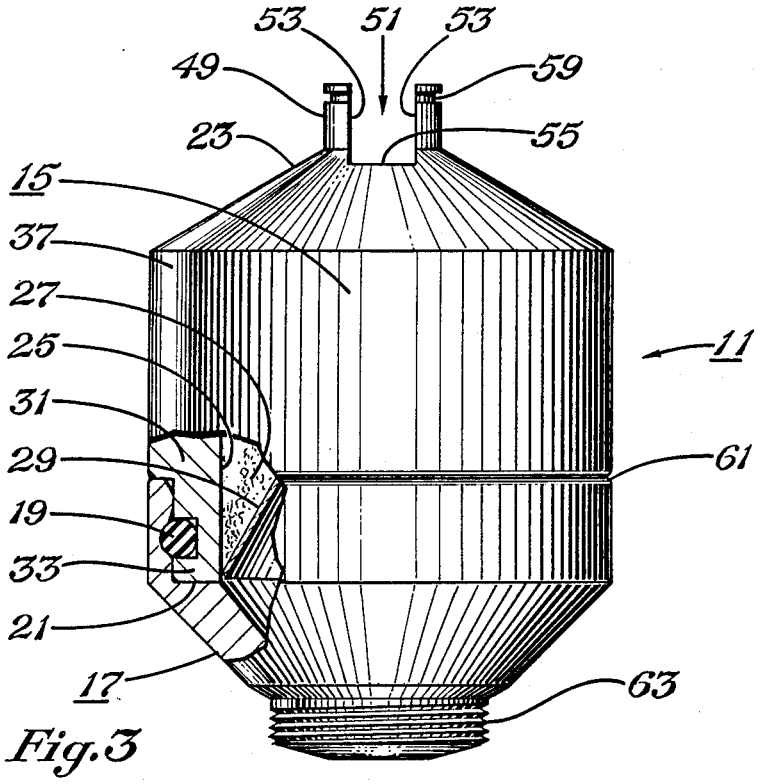
FIG. 3 is a partial cut away view of the shaped charge showing the O-ring arrangement.
Figure 4:
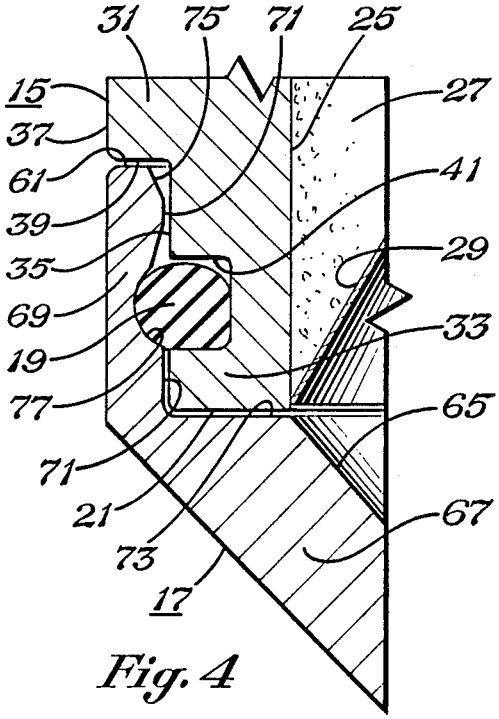
FIG. 4 is a schematic detailed transverse cross-sectional view of the O-ring arrangement of FIG. 3 showing the deformation of the O-ring under external pressure.
Figure 5:
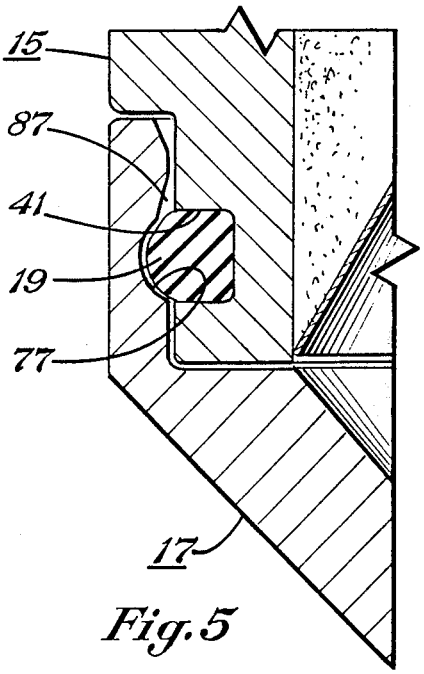
FIG. 5 is a schematic detailed transverse cross-sectional view of the O-ring arrangement of FIG. 3 showing the deformation of the O-ring under internal pressure.
Figure 6:
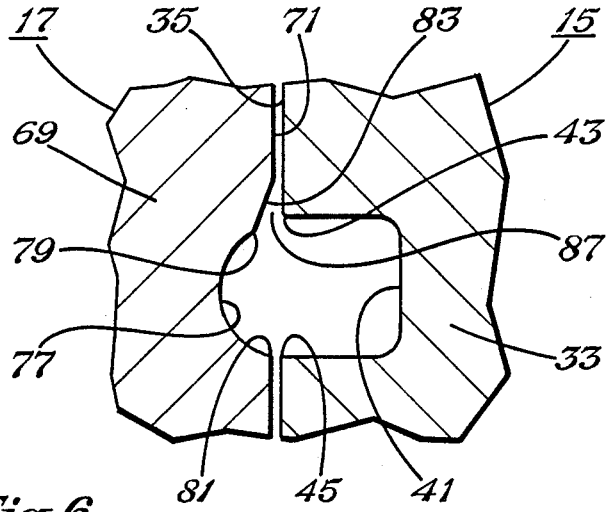
FIG. 6 is a detailed transverse cross-sectional view of the channel formed by the case groove and the cap groove.

The shaped charge case 15 is generally cylindrical and has first and second ends 21, 23. Referring to FIGS. 3–5, the metal case 15 has a cavity 25 therein. The cavity 25, which receives an explosive charge 27 and a liner 29, opens to the case first end 21. A cylindrical side wall 31 extends from the first end 21 towards the second end 23. The case side wall 31 is reduced in thickness at the case first end 21, where it forms a lip 33. The outside portion of the lip 33 has a first surface 35 which is cylindrical and circumferentially surrounds the cavity 25 at the case first end 21 (see also FIG. 2). The first surface 35 is of a smaller diameter than the exterior surface 37 of the case 15. The first surface 35 merges with a shoulder surface 39 which in turn merges with the case exterior surface 37. The lip 33 has a circumferential groove 41 that opens to the first surface 35. Referring to FIG. 6, the groove 41 has first and second edges 43, 45 which are those edges where the groove intersects the first surface 35. The first edge 43 extends circumferentially around the lip 33 and is located in an imaginary transverse plane that is perpendicular to the first surface 35. Likewise, the second edge 45 extends circumferentially around the lip 33 and is located in another imaginary transverse plane that is perpendicular to the first surface 35. The distance between the first and second edges is sized slightly larger than the transverse cross-sectional diameter of the O-ring 19. The groove 41 has a rectangular transverse cross-section such that the distance between the first and second edges 43, 45 exceeds the groove's depth of penetration into the lip 33. The rectangular cross-section of the groove causes a portion of the O-ring to protrude out from the first surface 35.

The second end 23 of the case 15 has provision for receiving a portion of a length of detonating cord 47 (see FIGS. 1–3). The second end 23 has a projection 49 that extends in a direction opposite of the first end 21 of the case 15. The projection 49, which is cylindrical, is bifurcated to form a slot 51 having sides 53. At the closed end of the slot 51 is a booster wall 55. The booster wall 55 separates the portion of the detonating cord 47 located in the slot 51 from the explosive charge 27. The width of the slot 51 (the distance between the slot sides 53) is only very slightly greater than the diameter of the detonating cord 47. The depth of the slot 51 (the distance from the booster wall 55 to the free end of the projection 49) is such that the detonating cord 47 can be positioned contiguous to the booster wall 55, while allowing a spring metal push nut 57 to be pressed onto the projection 49. Near the free end of the projection 49 is a circumferential groove 59, for receiving and capturing the push nut 57.

The cap 17 is generally cylindrical and has first and second ends 61, 63 (see FIGS. 3–5). The metal cap 17 has a cavity 65 therein, which opens up towards the cap first end 61. A side wall 67 extends from the first end 61 towards the second end 63. A counterbore at the first end 61 of the cap reduces the thickness of the side wall 67 so as to form a lip 69. The inside portion of the lip 69 has a second surface 71 which is cylindrical and circumferentially surrounds the cap cavity 65 (see also FIG. 2). The second surface 71 merges with a shoulder surface 73 which in turn merges with the surface defining the cap cavity 65. The second surface 71 also merges with a beveled surface 75 which in turn merges with the first end 61. The beveled surface 75 eases assembly of the cap 17 over the O-ring and onto the case 15. The diameter of the second surface 71 is slightly greater than the diameter of the first surface 35, while the longitudinal length (the distance between the respective first end and the respective shoulder surface) of the second surface is about the same as that of the first surface. The cap lip 69 has a circumferential groove 77 that opens to the second surface 71. The cap groove 77 has a transverse cross-section that is arcuate in shape and is sized smaller than a semi-circle. Referring to FIG. 6, the cap groove 77 has first and second edges 79, 81. The second edge 81 is formed by the intersection of the cap groove 77 and the second surface 71. In the preferred embodiment, the first edge 79 is formed by the intersection of the cap groove 77 and a beveled surface 83. The beveled surface 83 merges with the cap second surface 71. Because of the beveled surface 83, a gap 87 is formed between the case groove first edge 43 and the cap groove first edge 79, which gap 87 is much larger than the normal clearance between the first and second surfaces 35, 71. The beveled surface 83 and the gap 87 it forms is for the bleeding off of internal pressure within the assembled shaped charge. This internal pressure bleed-off feature will be explained in more detail hereinbelow. Because of the beveled surface 83, the diameter of the cap groove first edge 79 is sized between the diameter of the second surface 71 and the diameter of the bottom of the cap groove 77. The cap groove 77 is dimensioned to matingly receive that portion of the O-ring 19 that protrudes from the case first surface 35. The cap groove 77 is located along the cylindrical second surface 71 such that when the cap 17 is assembled onto the case 15 the second edge 81 of the cap groove is located in the same transverse plane as the case groove second edge 45.

The second end 63 of the cap 17 is a cylindrical member of smaller diameter than the cap. The second end is threaded so as to matingly engage a threaded opening 85 in the shaped charge carrier 13 (see FIG. 2).

To assemble the shaped charge 11 of the present invention, the explosive charge 27 and liner 29 are located in the cavity 25 of the case 15 and the O-ring 19 is assembled into the case groove 41. A portion of the O-ring 19 protrudes outwardly from the first surface 35. Next, the cap 17 is assembled onto the case 15 by inserting the first end 21 of the case into the first end 61 of the cap. The beveled surface 75 of the cap 17 aids in assembly by compressing the O-ring 19. The case 15 is forcefully inserted into the cap 17 until that portion of the O-ring 19 which protrudes from the first surface 35 of the case is received by the cap groove 77, wherein the cap is now retained onto the case by the O-ring. When the shaped charge 11 is assembled, the first and second surfaces 35, 71 face each other, being separated only by a small clearance and with the second surface 71 completely surrounding and overlapping the first surface. The case cavity 25 combines with the cap cavity 65 to form a single enclosed cavity inside of the shaped charge 11. The case first end 21 faces the cap shoulder surface 73 and the cap first end 61 faces the case shoulder surface 39. The case groove 41 is aligned with the cap groove 77 such that the respective second edges 45, 81 lie in the same transverse plane. Referring to FIG. 6, the alignment of the case groove 41 with the cap groove 77 forms a channel for receiving the O-ring 19 (in FIG. 6 the O-ring is not shown for clarity), which channel surrounds the single cavity inside of the shaped charge such that the O-ring 19 provides a circumferential seal between the case and the cap. The O-ring 19 holds the case 15 and the cap 17 together in the assembled position as shown in FIG. 3 but allows the case 15 to rotate relative to the cap 17. The O-ring 19 also lies in a plane which is perpendicular to the first and second surfaces 35, 71.

The assembled shaped charge 11 is mounted onto the shaped charge carrier 13 (see FIGS. 1 and 2) by screwing the second end 63 of the cap 17 into the threaded opening 85 in the carrier, until a tight fit is achieved. Then, the case 15 is rotated relative to the cap 17 to bring the slot 51 into parallel alignment with the carrier 13 as shown in FIG. 1. This allows the detonating cord 47 to be assembled onto the shaped charge so as to extend parallel to the carrier 13. A portion of the detonating cord 47 is laid into the slot 51, such that the detonating cord portion contacts the booster wall 55. Then, the push nut 57 is pressed onto the projection 49 until the push nut is received and captured by the circumferential groove 59.

In the preferred embodiment, the O-ring 19 is made of either a high temperature resistant fluorocarbon or a nitrile rubber. The O-ring 19 is a 100 series O-ring and has a transverse cross-sectional diameter of 0.103 inches. The distance between the first and second edges 43, 45 of the case groove 41 is about 0.110 inches and the case groove penetrates about 0.073 inches into the case lip 33. The cap groove 77 penetrates about 0.018 inches into the cap lip. For ease of assembly, about 80% of the O-ring 19 is received by the case groove 41 with the remaining 20% of the O-ring received by the cap groove 77. The clearance between the first and second surfaces 35, 71 at the case groove second edge 45 and the cap groove second edge 81, when the shaped charge is assembled, is about 0.002 inches (in the drawings the clearances are exaggerated for clarity). The gap 87 formed by the clearance between the case groove first edge 43 and the cap groove first edqe 79 (when the shaped charge is assembled) is about 0.035 inches wide. The explosive charge is, among numerous possibilities, cyclonite (commonly referred to as RDX).

When the case 15 and the cap 17 are assembled together, the O-ring 19 and its associated groove structure 41, 77 permit the bleed off of internal pressure while sealing against external pressure. Internal pressure exits the shaped charge through the passageway formed by: the clearance between the case first end 21 and the cap shoulder surface 73; between the first and second surfaces 35, 71; between the O-ring 19 and the cap groove 77; through the gap 87; between the first, second, and beveled surfaces 35, 71, 75 and between the case shoulder surface 39 and the cap first end 61. In FIG. 4, the O-ring 19 is shown in a state of deformation due to the external pressure on the shaped charge 11 being greater than the internal pressure. Such a situation arises when the shaped charge is lowered into a borehole where increasing hydrostatic pressure due to drilling fluids is encountered with increasing depth. The external pressure reaches the O-ring 19 through the clearances between the first and second surfaces 35, 71 and between the cap first end 61 and the case shoulder surface 39. The external pressure deforms the O-ring 19 such that the O-ring seals off the clearance between the case groove second edge 45 and the cap groove second edge 81 from the external pressure. Thus, the O-ring 19 provides a seal against external pressure, whereby the explosive charge inside of the shaped charge is kept dry.

In FIG. 5, the O-ring 19 is shown in a state of deformation due to internal pressure inside of the shaped charge being greater than the external pressure. Such a situation typically arises when the shaped charge 11 has been lowered into a borehole where it is subjected to high temperatures (which high temperatures cause the explosive charge 27 to gasify) and then the shaped charge is brought back up to the surface in an unfired condition. The internal pressure reaches the O-ring 19 through the clearances between the first and second surfaces 35, 71 and between the case first end 21 and the cap shoulder surface 73. The internal pressure deforms the O-ring 19 in a direction towards the cap first end 61. Unlike the situation with external pressure, the O-ring 19, as deformed by internal pressure, is unable to seal off the space between the case groove first edge 43 and the cap groove first edge 79 because of the gap 87 formed between the first edges 43, 79. The O-ring 19 extrudes into the gap 87 and fails to seal against the first edges 43, 79 of the grooves, thereby preventing the establishment of a seal and allowing internal pressure to bleed off. When the internal pressure is vented, the O-ring returns to its undeformed state wherein it provides a seal against external pressure.

Figure 7:
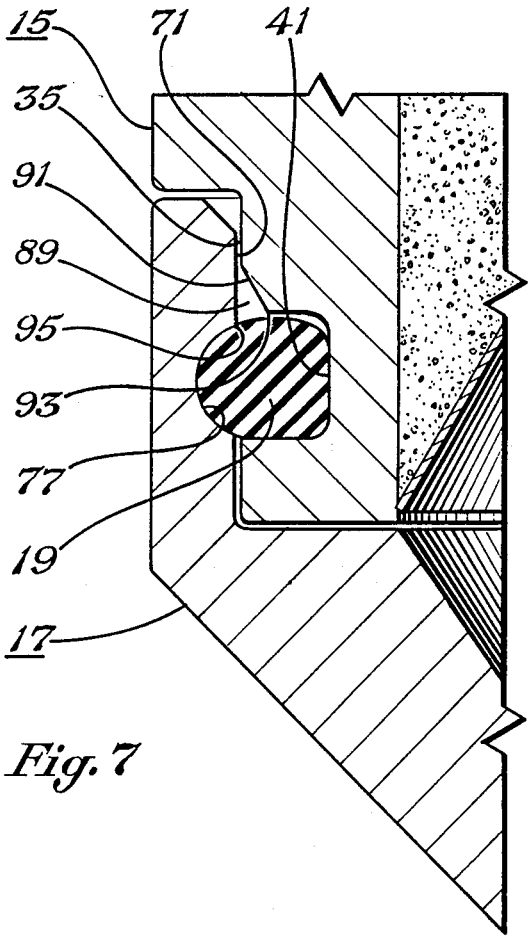
FIG. 7 is a detailed transverse cross-sectional view of an O-ring arrangement in accordance with another embodiment.

In FIG. 7, there is shown a transverse cross-sectional view of a shaped charge O-ring arrangement in accordance with another embodiment. This embodiment differs from the embodiment shown in FIGS. 1–6 in the gap arrangement. In this embodiment, the gap 89 is formed by a beveled surface 91 on the case groove 41. The first edge 93 of the case groove 41 is formed by the intersection of the case groove and the beveled surface 91. The beveled surface 91 merges with the case first surface 35. The first edge 95 of the cap groove 77 is formed by the intersection of the cap groove and the second surface 71. Thus, the gap 89 is formed between the case groove first edge 93 and the cap groove first edge 95. The beveled surface 91 results in the diameter of the case groove first edge 93 being sized between the case first surface 35 and the diameter of the bottom of the case groove 41. As in the embodiment shown in FIGS. 4–6, the gap 89 prevents the O-ring 19 from establishing a seal between the case 15 and the cap 17 when the O-ring is deformed as a result of the internal pressure of the shaped charge being greater than the external pressure.

Figure 8:
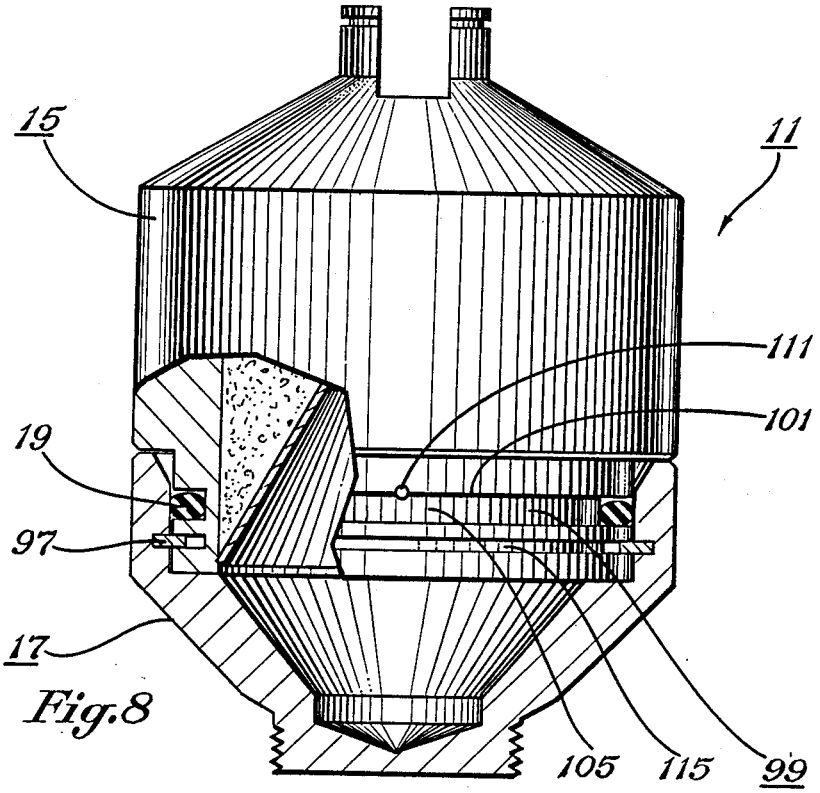
FIG. 8 is a partial cut away view of the shaped charge showing the O-ring arrangement in accordance with still another embodiment.
Figure 9:
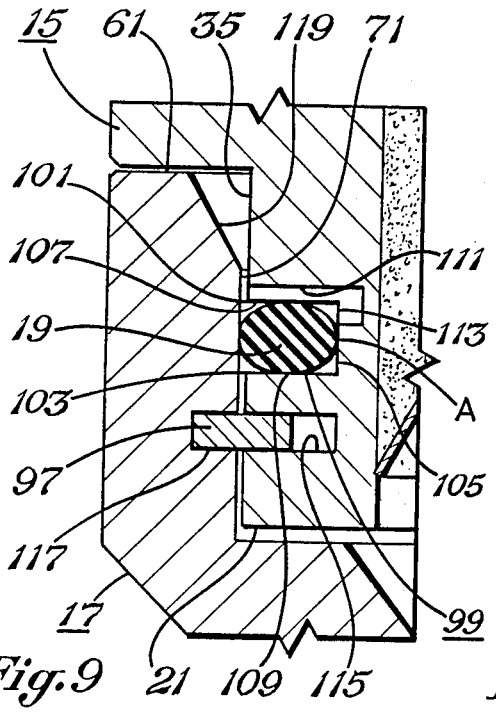
FIG. 9 is a detailed transverse cross-sectional view of the O-ring arrangement of FIG. 8, along with the borehole.
Figure 10:
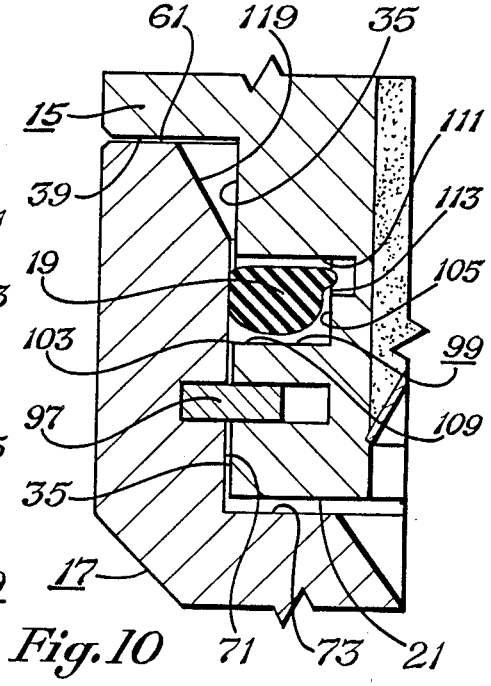
FIG. 10 is a detailed transverse cross-sectional view like FIG. 9, but showing the deformation of the O-ring under internal pressure.

In FIGS. 8–10, there is shown a shaped charge of the present invention, in accordance with still another embodiment. In addition to the case 15, the cap 17, and the O-ring 19, the shaped charge 11 includes a snap ring 97 to retain the case and the cap together. This embodiment differs from the embodiment shown in FIGS. 1–6 in the O-ring arrangement and the snap ring arrangement.

The O-ring 19 is received entirely by a circumferential seal groove 99 in the case 15. The seal groove 99 opens to the first surface 35 and has first and second edges 101, 103. The first and second edges 101, 103 are formed where the seal groove 99 intersects the first surface 35. The seal groove 99 has a back or bottom wall 105 which is concentric with the first surface 35. The seal groove also has a first edge wall 107, which extends between the first edge 101 and the back wall 105, and a second edge wall 109, which extends between the second edge 103 and the back wall 105.

Internal pressure is bled off from the shaped charge 11 by way of a cylindrical borehole which forms a gap 113 in the back wall 105 of the seal groove 99. The borehole 111 extends into the case from the first surface 35 towards the case cavity 25; the borehole however stops short of penetrating the lip all the way to the case cavity. In the preferred embodiment, the borehole 111 intersects the first edge 101 of the seal groove 99 thus making a portion of the borehole coincident with a portion of the seal groove. The borehole 111 extends into the case beyond the back wall 105 of the seal groove so as to make the gap 113 in the back wall.

When the case 15 and the cap 17 are assembled together, the O-ring 19 provides a circumferential seal between the case and the cap. The O-ring 19 seals at a position along the cap second surface 71 and also at a position along the seal groove back wall 105. When the O-ring is not deformed due to external fluid pressure or internal gas pressure, the O-ring seals along the groove back wall 105 at a position A which is in the same transverse plane as the center of the O-ring and along the cap second surface 71 at a position which is also in the same transverse plane as the center of the O-ring. If the internal pressure exceeds the external pressure, the O-ring deforms towards the first edge wall 107 of the seal groove as shown in FIG. 10. The deformation causes the positions of the seals between the O-ring 19 and the back wall 105 and between the O-ring and the second surface 71 to move towards the first edge wall 107. If the external pressure exceeds the internal pressure, the O-ring deforms towards the second edge wall 109 of the sealing groove. Such deformation under external pressure causes the positions of the seals between the O-ring and the back wall 105 and between the O-ring and the second surface 71 to move towards the second edge wall 109 thereby sealing the clearance between edge 103 and surface 71.

In order to prevent any external pressure from bypassing the O-ring 19 via the gap 113 in the back wall 105, the gap is positioned entirely between the first edge wall 107 and the position A of the seal between the O-ring and the back wall 105 when the O-ring is not deformed by external fluid or internal gas pressures. Under external pressures too low to deform the O-ring, the shaped charge remains sealed. As the shaped charge is subjected to sufficiently large external pressures, the O-ring 19 will deform towards the second edge wall 109 sealing the clearance between the edge 103 and the surface 71, and no external pressure will enter the shaped charge enclosed cavity.

As the O-ring is subjected to an internal pressure exceeding the external pressure, the O-ring is deformed towards the first edge wall 107 (see FIG. 10). That portion of the O-ring 19 which is adjacent to the borehole 111 extrudes into the borehole and into the gap 113. Internal pressure exits the shaped charge through the passageway formed by: the clearance between surfaces 21 and 73; between surfaces 35 and 71; between O-ring 19 and walls 109, 105; through the gap 113 in the back wall 105; through the borehole 111; the clearance between surfaces 35 and 71; between surfaces 119 and 35, 39 and between surfaces 39 and 61 which communicates with the exterior of the shaped charge. When the internal pressure is vented, the O-ring returns to its pre-venting state wherein it is undeformed by external pressure or internal pressure (as shown for example in FIG. 9) and wherein it provides a seal against external pressure.

In the preferred embodiment, the diameter of the borehole 111 is 0.093 inches. The borehole 111 extends (1/16 ) one sixteenths inches beyond the back wall 105 of the groove 99. The maximum dimension of the gap 113, which is measured from the first edge wall 107 towards position A is 0.049 inches. The distance between the gap 113 in the back wall and the seal position A of the undeformed O-ring is 0.005 inches. The O-ring 19 is a 100 series O-ring and has a transverse cross-sectional diameter of 0.103 inches.

The case 15 and the cap 17 are retained together entirely by the snap ring 97. The snap ring 97 is a circular spring ring member with a gap formed through the structure of the ring. The snap ring 97 is received by circumferential retainer grooves 115, 117 formed in the case and the cap. The retainer grooves 115, 117 open up respectively to the first and second surfaces 35, 71 and are aligned with each other to form a channel when the case and the cap are assembled together. The retainer groove 115 in the case is deep enough to receive the entire snap ring 97 when the snap ring is compressed to a small diameter. The second surface 71 of the cap merges with a beveled surface 119, which in turn merges with the cap first end 61. The beveled surface 119 receives the snap ring 97 in its uncompressed state. During assembly, the snap ring 97 is inserted into the case retainer groove 115. The case and the cap are assembled together with the first end 61 of the cap receiving the first end 21 of the case. The snap ring 97 is compressed inwardly by the beveled surface 119 to allow the snap ring to pass across the cap second surface 71. The snap ring 97 expands outwardly into both grooves 115 and 117 when the case and cap are assembled together and the grooves 115 and 117 are aligned as shown in FIGS. 8–10. The snap ring 97 does not block the flow of internal pressure between surfaces 35 and 71.

The foregoing disclosure and the showing made in the drawings are merely illustrative of the principles of this invention and are not to be interpreted in a limiting sense.

I claim:

1. A shaped charge comprising:

(a) a shaped charge case having first and second ends and a cavity therein, said case cavity opening up to said case first end, said case first end having a first surface that is circumferential, said case second end having means for holding a portion of a detonating cord;

(b) a shaped charge cap having first and second ends and a cavity therein, said cap cavity opening up to said cap first end, said cap first end having a second surface that is circumferential and that is close to said first surface when said case and said cap are assembled together;

(c) said case and said cap being assembled together to form an enclosed cavity from said case and cap cavities by one of said first ends matingly receiving the other of said first ends such that said first and second surfaces face each other, with a passageway formed by a clearance between said first and second surfaces, said passageway extending between said enclosed cavity and the exterior of said shaped charge, said enclosed cavity being adapted to receive and hold an explosive charge;

(d) circumferential groove means for receiving elastomeric seal means, said groove means being located between said case and said cap when said case and said cap are assembled together, said groove means being formed in at least one of said surfaces such that said passageway extends through said groove means, said groove means substantially surrounding said seal means such that said seal means is confined within said groove means for blocking said passageway and providing a seal between said case and said cap;

(e) said groove means having spaced apart first and second portions such that said passageway extends from said first portion of said groove means to the exterior of said shaped charge and from said second portion of said groove means to said enclosed cavity;

(f) said first portion of said groove means having gap means sized and located such that when the internal pressure of said enclosed cavity becomes greater than the external pressure of said shaped charge said seal means is unable to close said passageway and the internal pressure vents to the exterior of said shaped charge;

(g) said gap means being blocked from communicating with said enclosed cavity and its internal pressure by said seal means when said seal means is undeformed by internal pressure.

2. The shaped charge of claim 1 wherein said gap means comprises an aperture which extends from said one surface and which is in communication with said groove means allowing communication between said groove means and said shaped charge exterior.

3. The shaped charge of claim 2 further comprising retainer means for retaining said case and said cap together in the assembled condition, said retainer means being received by respective retainer grooves in said case and said cap.

4. The shaped charge of claim 1 wherein said groove means first portion comprises a beveled surface which merges with said groove means and said one surface in which said groove means is formed, said beveled surface forming said gap means between said first and second surfaces, said gap means communicating with the exterior of said shaped charge by said passageway.

5. The shaped charge of claim 4 wherein said seal means retains said case and said cap together in the assembled condition.

6. A shaped charge, comprising:

(a) a shape charge case having first and second ends and a cavity therein, said case cavity opening up to said case first end, said case first end having a first surface that is circumferential and extends longitudinally towards said case first and second ends, said first surface having a circumferential groove, said case groove opening up to said first surface and having first and second edges, said case second end having means for holding a portion of a detonating cord;

(b) a shaped charge cap having first and second ends and a cavity therein, said cap cavity opening up to said cap first end, said cap first end having a second surface that is circumferential and close to said first surface when said case and said cap are assembled together, said second surface having a circumferential groove, said cap groove opening up to said second surface and having first and second edges that correspond to said case groove first and second edges when said case and cap are assembled together, said cap comprising means for coupling said shaped charge to a shaped charge carrier;

(c) said case and said cap being assembled together to form an enclosed cavity from said case and cap cavities by one of said first ends matingly receiving the other of said first ends such that said first and second surfaces face each other and said case groove is aligned with said cap groove so as to form a circumferential channel, said enclosed cavity being adapted to receive and hold an explosive charge, said case and said cap being separated from each other by a clearance, said assembled case and cap having a passageway extending between said enclosed cavity and the exterior of the shaped charge, said passageway being formed by said clearance;

(d) said case groove being aligned with said cap groove when said case and said cap are assembled such that said case and said cap second edges lie in the same transverse plane, said second edges being separated from each other by said clearance, said second edges communicating with said enclosed cavity by said clearance, said case groove and said cap groove being aligned with each other such that said case and cap first edges are separated from each other by gap means, said gap means communicating with the exterior of said shaped charge by said clearance;

(e) elastomeric seal means fitted inside of said aligned case and cap grooves between said first edges and said second edges, wherein said seal means provides a circumferential seal between said case and said cap;

(f) said clearance between said respective second edges being sized so as to allow the establishment of a seal by said seal means when pressure external to the shaped charge is greater than pressure internal to the shaped charge, and said gap means being sized so as to prevent the establishment of a seal by said seal means when pressure internal to the shaped charge is greater than pressure external to the shaped charge.

7. The shaped charge of claim 6 wherein:

(a) said second surface has a diameter, said cap groove has a bottom, said cap groove bottom has a diameter;

(b) said cap groove first edge has a diameter which is sized between the diameter of the second surface and the bottom diameter of the cap groove;

(c) said case groove first edge is formed by the intersection of said case groove with said first surface.

8. The shaped charge of claim 6 wherein:

(a) said first surface has a diameter, said case groove has a bottom, said case groove bottom has a diameter;

(b) said case groove first edge has a diameter which is sized between the diameter of the first surface and the bottom diameter of the case groove;

(c) said cap groove first edge is formed by the intersection of said cap groove with said second surface.

9. The shaped charge of claim 6 wherein said first and second surfaces are cylindrical.

10. The shaped charge of claim 9 wherein said seal means comprises an O-ring.

11. The shaped charge of claim 10 wherein:

(a) said second surface has a diameter, said cap groove has a bottom, said cap groove bottom has a diameter;

(b) said cap groove first edge has a diameter which is sized between the diameter of the second surface and the bottom diameter of the cap groove;

(c) said case groove first edge is formed by the intersection of said case groove with said first surface.

12. The shaped charge of claim 10 wherein:

(a) said first surface has a diameter, said case groove has a bottom, said case groove has a diameter;

(b) said case groove first edge has a diameter which is sized between the diameter of the first surface and the bottom diameter of the case groove;

(c) said cap groove first edge is formed by the intersection of said cap groove with said second surface.

13. A shaped charge, comprising:

(a) a shaped charge case having first and second ends and a cavity therein, said case cavity opening up to said case first end, said case first end having a cylindrical first surface that is circumferential, said first surface having a circumferential groove, said case groove opening up to said cylindrical first surface and having first and second edges, said case second end having means for holding a portion of a detonating cord;

(b) a shaped charge cap having first and second ends and a cavity therein, said cap cavity opening up to said cap first end, said cap first end having a cylindrical second surface that is circumferential, said second surface having a circumferential groove, said cap groove opening up to said cylindrical second surface and having first and second edges that correspond to said case groove first and second edges when said case and said cap are assembled together, said cap second end being adapted to couple to a shaped charge carrier;

(c) said case and said cap being assembled together to form an enclosed cavity from said case and cap cavities by one of said first ends matingly receiving the other of said first ends such that said first and second surfaces face each other and said case groove is aligned with said cap groove so as to form a circumferential channel, with a passageway formed by a clearance between said first and second surfaces, said passageway extending between said enclosed cavity and the exterior of said shaped charge, said enclosed cavity being adapted to receive and hold an explosive charge;

(d) said case groove being aligned with said cap groove when said case and said cap are assembled such that said case and cap second edges lie in the same transverse plane, each of said second edges being formed by the intersection of the respective groove and the respective cylindrical surface, said second edges being separated from each other by said clearance, said second edges communicating with said enclosed cavity by said passageway;

(e) one of said first edges being formed by the intersection of the respective cylindrical surface and the respective groove, the other of said first edges being formed by the intersection of the respective groove and a beveled surface, said beveled surface intersecting with said respective cylindrical surface, said first edges communicating with the exterior of said shaped charge by said passageway;

(f) said case groove and said cap groove being aligned with each other such that said case and cap first edges are separated from each other by gap means defined at least by said beveled surfaces;

(g) elastomeric seal means fitted inside of said aligned case and cap grooves between said first edges and said second edges, wherein said seal means provides a circumferential seal between said case and said cap;

(h) said seal means extruding into said gap means when the internal pressure of said enclosed cavity becomes greater than the external pressure of said shaped charge, wherein said seal means is unable to close said passageway and the internal pressure vents to the exterior of said shaped charge;

(i) said gap means being blocked from communicating with said enclosed cavity and its internal pressure when said seal means is undeformed by internal pressure.

14. A shaped charge, comprising:

(a) a shaped charge case having first and second ends and a cavity therein, said case cavity opening up to said case first end, said case first end having a first surface that is circumferential, said case second end having means for receiving a portion of a detonating cord;

(b) a shaped charge cap having first and second ends and a cavity therein, said cap cavity opening up to said cap first end, said cap first end having a second surface that is circumferential and close to said first surface when said case and said cap are assembled together, said cap comprising means for coupling said shaped charge to a shaped charge carrier;

(c) said case and said cap being assembled together to form an enclosed cavity from said case and cap cavities by one of said first ends matingly receiving the other of said first ends such that said first and second surfaces face each other with a passageway formed by a clearance between said first and second surfaces, said passageway extending between said enclosed cavity and the exterior of said shaped charge, said enclosed cavity being adapted to receive and hold an explosive charge;

(d) retainer means for retaining said case and said cap together in the assembled condition;

(e) a groove located on one of said surfaces, said groove being circumferential and opening up to said one surface, said groove having first and second edges, said first and second edges being formed by the intersection of said groove with said one surface, said groove having a wall;

(f) elastomeric seal means located in said groove for providing a circumferential seal between said case and said cap, said seal means providing a seal at a position along said other surface and providing a seal at a position along said groove wall;

(g) said groove first edge communicating with the exterior of said shaped charge by said passageway, said groove having an opening in said groove wall located between said first edge and the position along said groove wall that said seal means seals when said seal means is subjected to similar internal and external pressures, said opening communicating with the exterior of said shaped charge;

(h) said seal means extruding into said opening when the internal pressure of said enclosed cavity becomes greater than the external pressure of said shaped charge, wherein said seal means is unable to close said passageway and the internal pressure vents to the exterior of said shaped charge;

(i) said opening being blocked from communicating with said enclosed cavity and its internal pressure when said seal means is undeformed by internal pressure.

15. The shaped charge of claim 14 wherein said retainer means comprises snap ring means received by corresponding retainer grooves in said first and second surfaces.

16. The shaped charge of claim 14 wherein said groove wall opening is formed by an aperture extending from said one surface beyond said groove wall, said aperture opening up to said one surface.

17. The shaped charge of claim 14 wherein said first and second surfaces are cylindrical.

18. The shaped charge of claim 17 wherein said seal means comprises an O-ring.

19. The shaped charge of claim 18 wherein said groove wall opening is formed by an aperture extending from said one surface beyond said groove wall, said aperture opening up to said one surface.

20. The shaped charge of claim 17 wherein said retainer means comprises snap ring means received by corresponding retainer grooves in said first and second surfaces.

21. A shaped charge, comprising:

(a) a shaped charge case having first and second ends and a cavity therein, said case cavity opening up to said case first end, said case end having a cylindrical first surface that is circumferential, said first surface having a circumferential seal groove that opens up to said case first surface and has first and second edges, said seal groove having a wall, said case second end having means for receiving a portion of a detonating cord;

(b) a shaped charge cap having first and second ends and a cavity therein, said cap cavity opening up to said cap first end, said cap first end having a cylindrical second surface that is circumferential, said cap having a means for coupling said shaped charge to a shaped charge carrier;

(c) said case and said cap being assembled together to form an enclosed cavity from said case and cap cavities by one of said first ends matingly receiving the other of said first ends such that said first and second surfaces face each other with a passageway formed by a clearance between said first and second surfaces, said passageway extending between said enclosed cavity and the exterior of said shaped charge, said enclosed cavity being adapted to receive and hold an explosive charge;

(d) said first and second surfaces having respective retainer grooves that correspond with each other when said case and said cap are assembled together;

(e) retainer means for retaining said assembled case and cap together, said retainer means comprising a snap ring located in said respective retainer grooves, one of said first ends having a beveled surface for distorting the diameter of said snap ring during the assembly of said case and said cap such that said snap ring can be received by the respective retainer grooves;

(f) elastomeric seal means located in said seal groove for providing a circumferential seal between said case and said cap, said seal means providing a seal at a position along said second surface and providing a seal at a position along said seal groove wall;

(g) said seal groove first edge communicating with the exterior of said shaped charge by said passageway;

(h) an aperture extending into said case from said first surface beyond said seal groove wall, said aperture intersecting said seal groove first edge and communicating with said seal groove, said aperture forming an opening in said seal groove wall which is between said first edge and the position along said seal groove wall that said seal means seals when said seal means is subjected to similar internal and external pressures;

(i) said seal means extruding into said opening when the internal pressure of said enclosed cavity becomes greater than the external pressure of said shaped charge, wherein said seal means is unable to close said passageway and the internal pressure vents to the exterior of said shaped charge;

(j) said opening being blocked from communicating with said enclosed cavity and its internal pressure when said seal means is undeformed by internal pressure.

22. A shaped charge, comprising:

a first member comprising wall structure forming a cavity;

said wall structure of said first member having first and second ends with an opening at said first end leading to said cavity and formed by surrounding wall structure having an outward facing surface forming the outer boundary of said surrounding wall structure;

a second member comprising wall structure forming a cavity;

said wall structure of said second member having first and second ends with an opening at said first end of said second member leading to said cavity and formed by surrounding wall structure having an inward facing surface forming the inner boundary of said surrounding wall structure of said second member;

said first and second members being adapted to be assembled together with said first end of said first member located within said opening of said second member to form an enclosed cavity with said inward and outward facing surfaces facing each other and with a passageway formed by a clearance between said inward and outward facing surfaces;

said passageway extending between said enclosed cavity and the exterior of said shaped charge, said enclosed cavity being adapted to receive and hold an explosive charge;

groove means formed in said surface of said surrounding wall structure of at least one of said members such that said passageway extends through said groove means;

seal means adapted to be located in said groove means for blocking said passageway and providing a seal between said first and second members;

said groove means having spaced apart first and second portions such that said passageway extends from said first portion of said groove means to the exterior of said shaped charge and from said second portion of said groove means to said enclosed cavity;

said first portion of said groove means having gap means sized and located such that when the internal pressure of said enclosed cavity becomes greater than the external pressure of said shaped charge, said seal means is unable to close said passageway and the internal pressure vents to the exterior of said shaped charge;

said gap means being blocked from communicating with said enclosed cavity and its internal pressure by said seal means when said seal means is undeformed by internal pressure.

23. The shaped charge of claim 22, comprising:

groove means formed in said surface of said surrounding wall structure of the other of said members, said two groove means being aligned with each other forming a channel when said first and second members are assembled together with said seal means located in said channels, said seal means acting to retain said two members together in the assembled condition.

24. The shaped charge of claim 23, wherein:

said seal means comprises an elastomeric seal means.

25. The shaped charge of claim 22, comprising:

retainer means, inner and outer retainer grooves formed in said inner and outer surfaces respectively and which are aligned with each other when said first and second members are assembled together for receiving said retainer means for retaining said two members together in the assembled condition.

26. The shaped charge of claim 25, wherein:

said retainer means comprises ring means having a gap formed therethrough.

27. The shaped charge of claim 22, wherein:

said gap means comprises an aperture which extends from said surface of said surrounding wall structure of said one member and which is in communication with said groove means allowing communication between said groove means and the exterior of said shaped charge.

28. The shaped charge of claim 27, comprising:

retainer means, inner and outer retainer grooves formed in said inner and outer surfaces respectively and which are aligned with each other when said first and second members are assembled together for receiving said retainer means for retaining said two members together in the assembled condition.

29. The shaped charge of claim 28, wherein:

said retainer means comprises ring means having a gap formed therethrough.

* * * * *